US010057677B2

(12) United States Patent
Honda et al.

(10) Patent No.: US 10,057,677 B2
(45) Date of Patent: Aug. 21, 2018

(54) ELECTROACOUSTIC TRANSDUCER AND ACOUSTIC RESISTOR

(71) Applicant: Kabushiki Kaisha Audio-Technica, Tokyo (JP)

(72) Inventors: Yoji Honda, Tokyo (JP); Kenzo Tsuihiji, Tokyo (JP); Koichiro Tanoue, Tokyo (JP); Kenji Arai, Tokyo (JP)

(73) Assignee: KABUSHIKI KAISHA AUDIO-TECHNICA, Tokyo (JP)

( * ) Notice: Subject to any disclaimer, the term of this patent is extended or adjusted under 35 U.S.C. 154(b) by 0 days.

(21) Appl. No.: 15/586,359

(22) Filed: May 4, 2017

(65) Prior Publication Data

US 2017/0238089 A1 Aug. 17, 2017

Related U.S. Application Data

(63) Continuation of application No. 14/935,891, filed on Nov. 9, 2015.

(30) Foreign Application Priority Data

Nov. 18, 2014 (JP) ..... 2014-233918

(51) Int. Cl.
*H04R 25/00* (2006.01)
*H04R 1/28* (2006.01)
*H04R 1/10* (2006.01)

(52) U.S. Cl.
CPC ..... *H04R 1/2849* (2013.01); *H04R 1/1008* (2013.01)

(58) Field of Classification Search
CPC ..... H04R 1/1058; H04R 1/1075; H04R 7/14; H04R 1/1008; H04R 2499/11; H04R 17/00; H04R 1/1016; H04R 1/22; H04R 5/033
USPC ..... 381/370–389, 390; 181/164, 172, 173
See application file for complete search history.

(56) References Cited

U.S. PATENT DOCUMENTS 5,729,605 A * 3/1998 Bobisuthi ..... H04R 1/1041 379/430
9,451,355 B1 * 9/2016 Jankovsky ..... H04R 1/34
2002/0109938 A1 * 8/2002 Daniel ..... G11B 25/043 360/99.16
2004/0156521 A1 * 8/2004 Grell ..... H04R 1/2842 381/370

(Continued)

FOREIGN PATENT DOCUMENTS

JP 2013-251660 12/2013

*Primary Examiner* — Matthew Eason
*Assistant Examiner* — Julie X Dang
(74) *Attorney, Agent, or Firm* — W&C IP

(57) ABSTRACT

An electroacoustic transducer includes a driver, a diaphragm 13 driven to vibrate by the driver and emitting sound, a baffle 22 holding the driver and the diaphragm 13, first openings 25 extending through the baffle 22, an acoustic resistor 23 disposed on the back side of the baffle 22, and second openings 26 extending from the front side to the back side of the acoustic resistor 23. The baffle 22 is provided on the back side of the diaphragm 13. The first openings 25 are provided in the baffle 22. The second openings 26 are each disposed above one of the first openings 25 in the acoustic resistor 23. The electroacoustic transducer exhibits an excellent frequency response even if a sufficient volume of a space is not provided on the back side of the diaphragm 13.

4 Claims, 8 Drawing Sheets

(56) References Cited

U.S. PATENT DOCUMENTS

| | | | | |
|---|---|---|---|---|
| 2010/0119090 | A1* | 5/2010 | Graber | H04R 1/403 381/190 |
| 2011/0002475 | A1* | 1/2011 | Kimura | H04R 1/1008 381/71.6 |
| 2011/0051981 | A1* | 3/2011 | Lehdorfer | H04R 1/1075 381/380 |
| 2012/0195440 | A1* | 8/2012 | Yamagishi | H04R 1/2857 381/74 |
| 2014/0056459 | A1* | 2/2014 | Oishi | H04R 31/00 381/370 |
| 2014/0197259 | A1* | 7/2014 | Lefas | B02C 7/17 241/60 |
| 2015/0222980 | A1* | 8/2015 | Pizzaro | H04R 1/1058 381/371 |
| 2015/0249878 | A1* | 9/2015 | Wen | H04R 1/24 381/370 |

* cited by examiner

ELECTROACOUSTIC TRANSDUCER AND ACOUSTIC RESISTOR

TECHNICAL FIELD

The present invention relates to electroacoustic transducers and acoustic resistors.

BACKGROUND ART

Electroacoustic transducers, such as headphone sets and loudspeakers, are known that convert electrical signals into sounds. Such an electroacoustic transducer includes a driver unit composed of a driver and a diaphragm. To achieve stable operation of the driver unit, required is a space having a sufficient volume and disposed on the side opposite to the side through which the sound emitted from the diaphragm passes. The space is defined by a housing covering the driver unit. The side opposite to the sound emitting side is referred to as a "back side". The space on the back side in the housing is referred to as a "back space".

However, an electroacoustic transducer particularly in the form of a headphone set has an insufficient volume of a back space due to demands for design and size reduction in some cases. Such an electroacoustic transducer with an insufficient volume of a back space restricts air stiffness and acoustic design of mass components. The restrictions on the acoustic design increase the sharpness (Q factor) of the driver unit of the electroacoustic transducer. Small electroacoustic transducers, such as headphone sets, earphones, and tabletop loudspeakers, have difficulty exhibiting a smooth frequency response with a high level of sharpness of the driver units.

To solve this problem, an acoustic resistor is known that includes a baffle that has holes and fixes the back side of a diaphragm and acoustic resistors that are composed of felt, for example, and are fit in the holes. The acoustic resistors exhibit acoustic filtering effects.

Japanese Unexamined Patent Application Publication No. 2013-251660 discloses a technique for forming a sound-path space between a flange disposed on the back side of a diaphragm and an acoustic resistor disposed at a predetermined distance from the back surface of the flange in a headphone set.

Unfortunately, even in the above-described electroacoustic transducer having the baffle structure to achieve acoustic filtering effects on the back side of the diaphragm, the frequency response can be improved only in a narrow sound band and thus cannot be improved in a wide sound band.

SUMMARY OF INVENTION

Technical Problem

An object of the present invention is to provide an electroacoustic transducer that can exhibit an excellent frequency response even if a sufficient volume of a space is not provided on the back side of a diaphragm.

Solution to Problem

The present invention relates to an electroacoustic transducer including a driver, a diaphragm driven to vibrate by the driver and emitting sound, a baffle holding the driver and the diaphragm, first openings extending through the baffle, an acoustic resistor disposed on the back side of the baffle, and second openings extending from the front side to the back surface of the acoustic resistor. The baffle is provided on the back side of the diaphragm. The first openings are provided in the baffle. The second openings are provided at positions corresponding to the first openings in the acoustic resistor.

Advantageous Effects of Invention

The electroacoustic transducer of the present invention has a variable acoustic impedance and exhibits an excellent frequency response even if a sufficient volume of a space is not provided on the back side of a diaphragm.

DESCRIPTION OF EMBODIMENTS

Embodiments of an electroacoustic transducer of the present invention will now be described with reference to the attached drawings.

Headphone Set (1)

Figure 1:
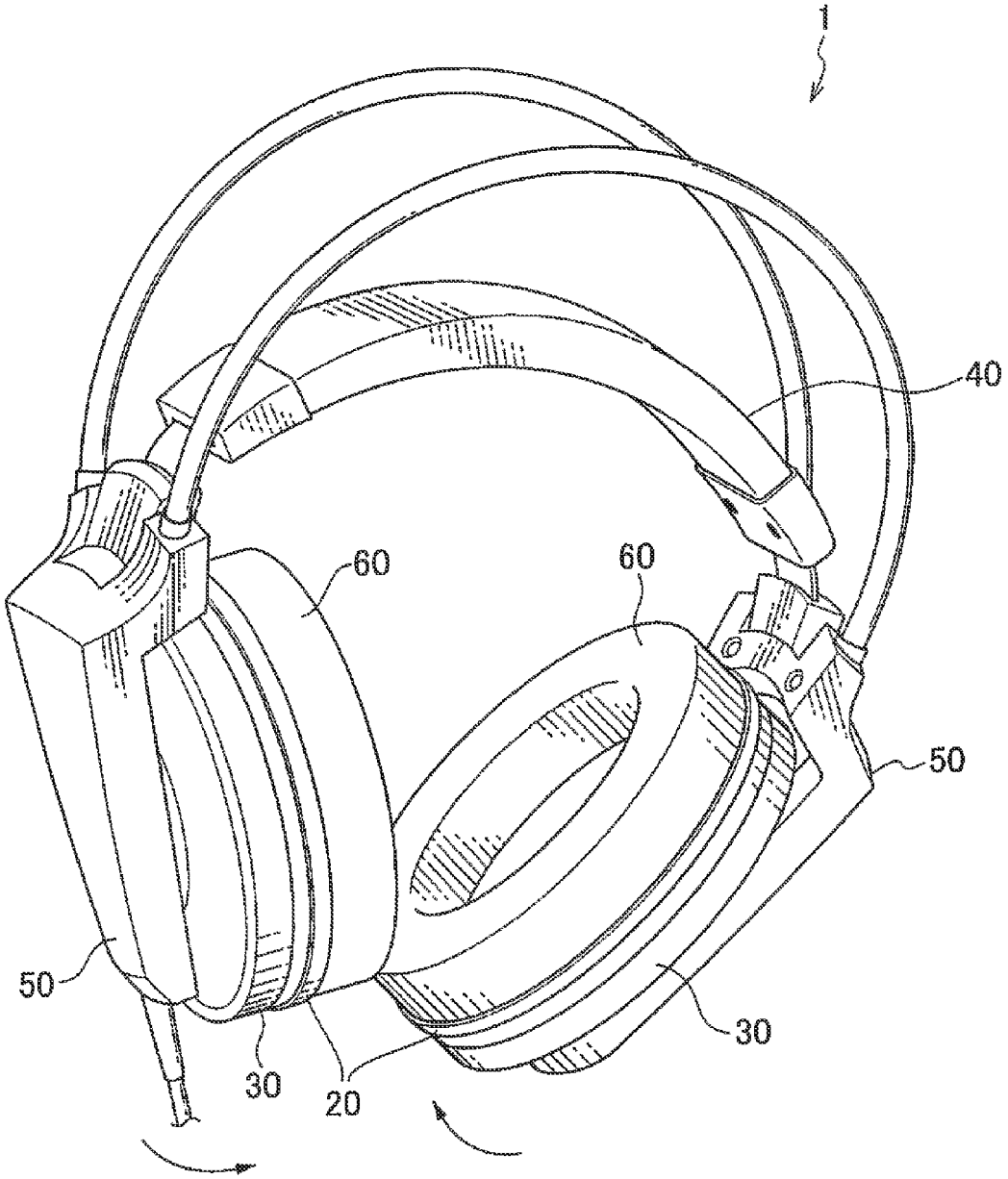
FIG. 1 is a perspective view of a headphone set that is an embodiment of an electroacoustic transducer of the present invention.
Figure 2:
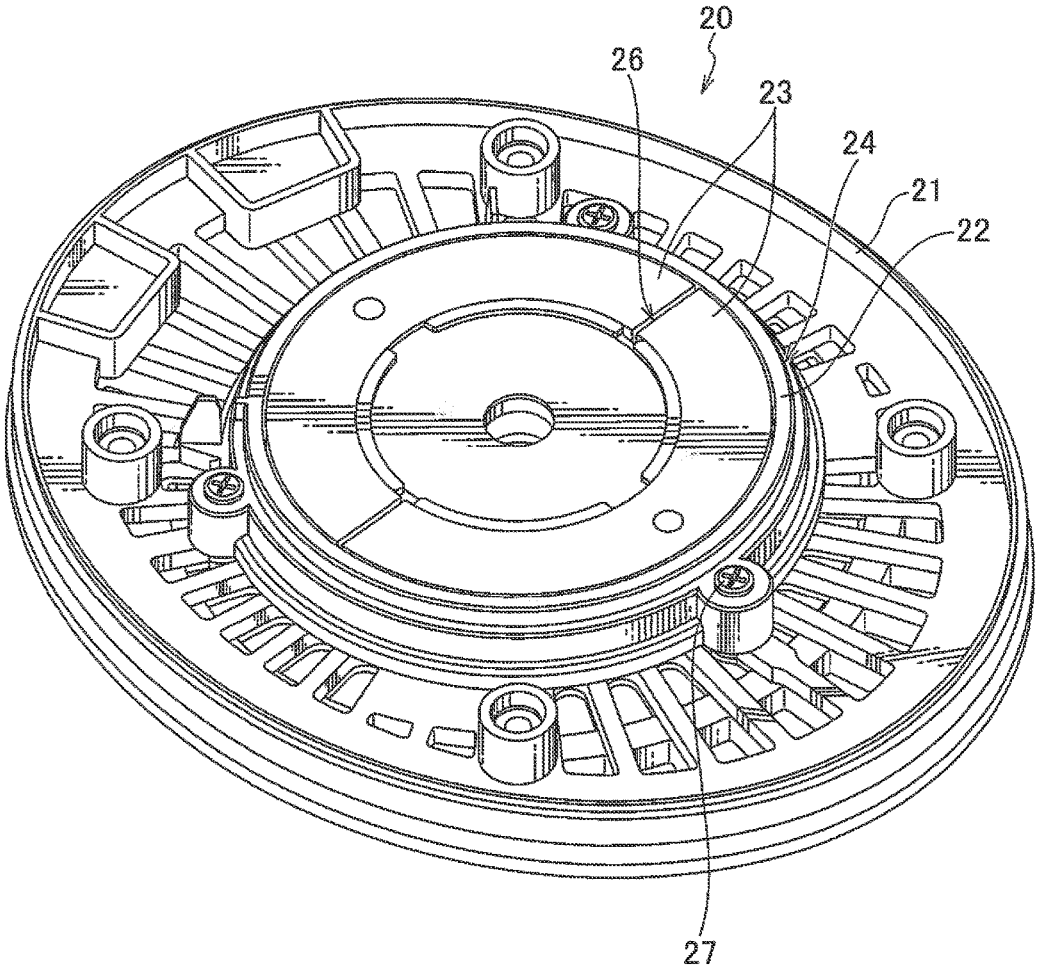
FIG. 2 is a perspective view of a baffle assembly of the headphone set in FIG. 1.
Figure 3:
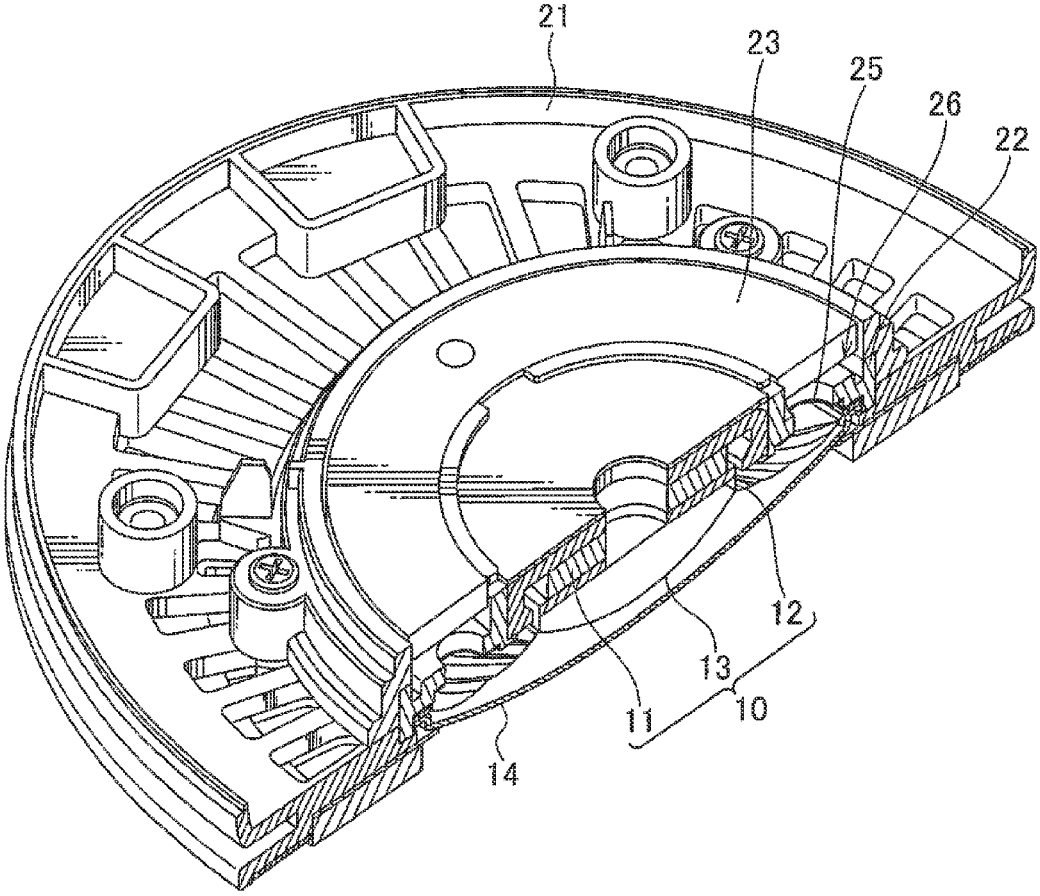
FIG. 3 is a perspective cross-sectional view of the baffle assembly in FIG. 2.

With reference to FIGS. 1 to 3, a headphone set 1, which is an embodiment of an electroacoustic transducer of the present invention, includes driver units 10, which are driven in response to electrical signals and output sound, and baffle assemblies 20 in which the driver units 10 are mounted. The headphone set 1 also includes housings 30 attached to the respective baffle assemblies 20 to form headphone units and a headband 40 for holding the headphone set 1 on the head of a user. The headphone set 1 also includes supports 50 and ear pad 60. Each support 50 is connected to the headband 40 and holds the corresponding housing 30. The ear pads 60 come into contact with the ear regions of the user in use. The headphone units each have a substantially oval•cylindrical shape to cover the ear regions of the user.

FIG. 2 is a perspective view of the baffle assembly 20 viewed from the back side. In the following description, the side of the baffle assembly 20 toward which the driver unit 10 outputs sound is referred to as a front side, while the side opposite to the front side is referred to as a back side. The housing 30 illustrated in FIG. 1 is provided on the back side of the driver unit 10. In the headphone set 1, the baffle assembly 20 and the housing 30 define a back air chamber ensuring a back space of the diaphragm 13. The baffle assembly 20 is composed of a first baffle 21, and a second baffle 22, and other components attached to the first baffle 21. The second baffle 22 holds the driver unit 10.

With reference to FIG. 3, the driver unit 10 includes a magnet 11 for generating a magnetic field and a voice coil 12 disposed in the magnetic field generated by the magnet 11 and driven in response to electrical signals. The driver unit 10 also includes a diaphragm 13 to which the voice coil 12 is attached. The diaphragm 13 vibrates together with the voice coil 12 to output sound. A protector 14 is disposed on the front side of the driver unit 10. The protector 14 protects the diaphragm 13 and has multiple holes that allow sound to pass therethrough.

The first baffle 21 is shaped in conformance with the headphone unit. The headphone unit has a substantially oval-cylindrical shape, and accordingly, the first baffle 21 has a substantially oval-plate shape.

The first baffle 21 includes a driver-unit mounting section 24 that opens in a substantially circular shape so as to conform to the shape of the driver unit 10.

Figure 4:
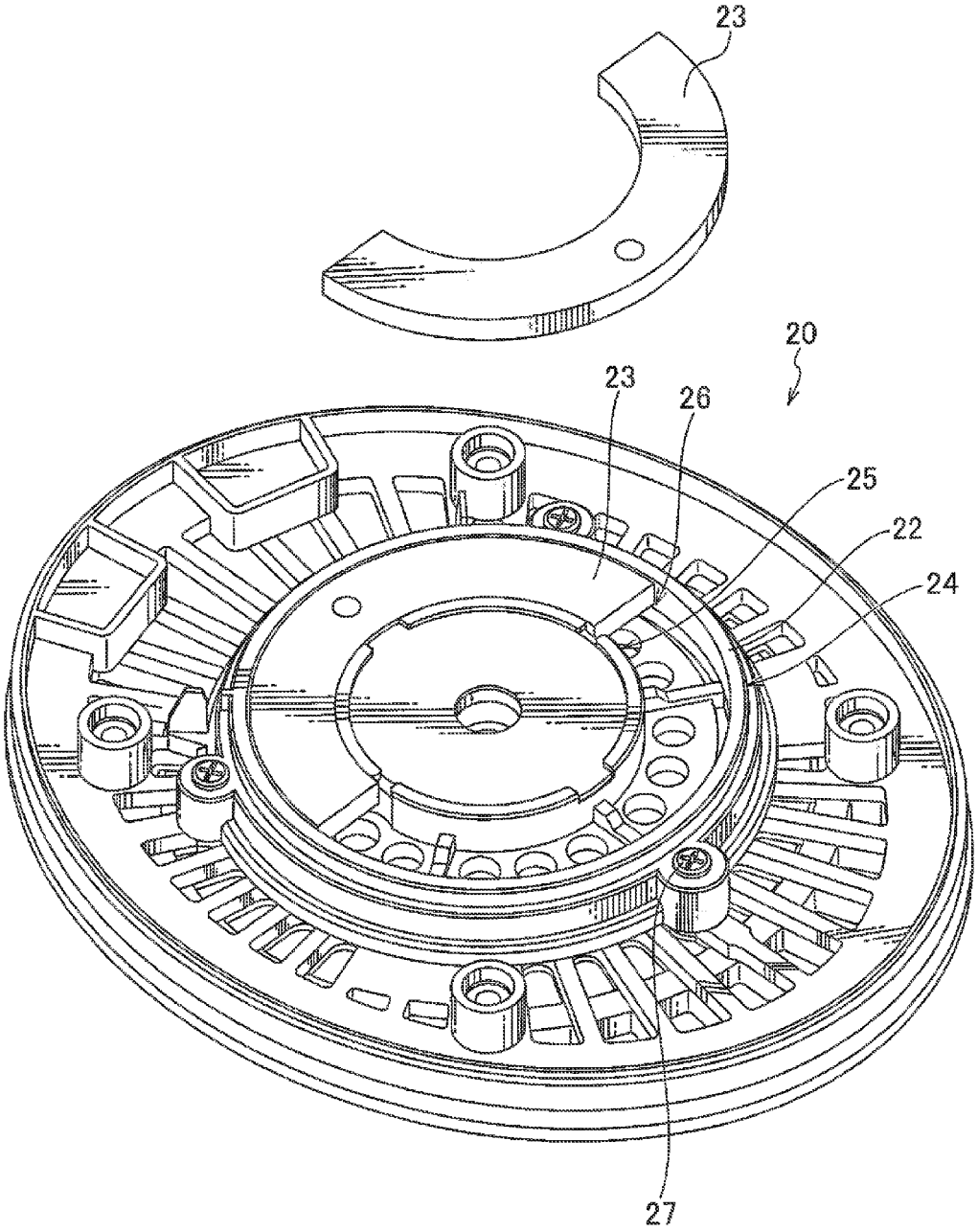
FIG. 4 is a perspective view of the baffle assembly in FIG. 2 from which an acoustic filter is removed.

With reference to FIG. 4, the second baffle 22 has a substantially circular shape conforming to the shape of the driver unit 10 and the shape of the opening of the driver-unit mounting section 24.

The second baffle 22, which is a focus of the present invention, holds the back side of the driver unit 10. The second baffle 22 and the driver unit 10 are mounted in the driver-unit mounting section 24 of the first baffle 21 with fixing members, such as screws 27. The second baffle 22 is disposed on the back side of the diaphragm 13 and has first openings 25 extending through the second baffle 22. An acoustic filter 23 is provided on the back side of the second baffle 22 to cover the first openings 25.

The acoustic filter 23 is an acoustic resistor covering the first openings 25 to attenuate the sound emitted from the diaphragm 13 and passing through the first openings 25. The acoustic filter 23 allows the sound to pass therethrough while attenuating it. The acoustic filter 23 is thus formed of a material having a predetermined air permeability (acoustic resistance), such as felt. Felt is composed of entangled fibers and thus has rough surfaces and cross sections, generating a high kinetic friction against passing air. The acoustic filter 23 is formed of felt, which has a high coefficient of kinetic friction against air. The acoustic filter 23 has a predetermined thickness.

The acoustic filter 23 is composed of multiple, for example, two segments each having a substantially semicircular shape so as to be accommodated between the inner peripheral walls of the second baffle 22. The ends of the two segments of the acoustic filter 23 face each other with gaps therebetween. The gaps between the two segments of the acoustic filter 23 extend from the front side to the back side of the acoustic filter 23 and serve as second openings 26. The second openings 26 function as acoustic impedance against sound waves emitted from the diaphragm 13 and passing through the second openings 26.

Figure 5:
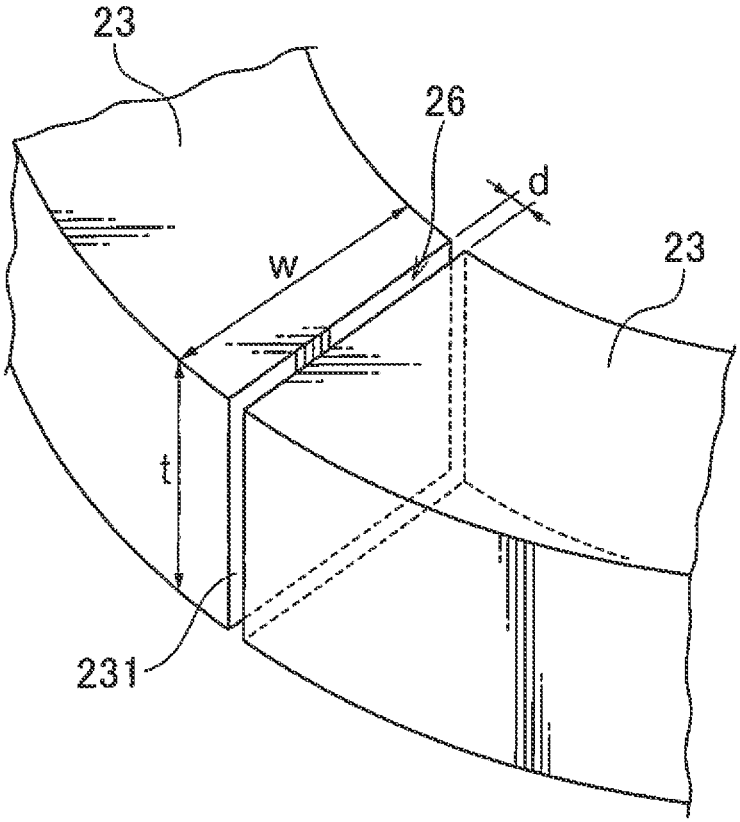
FIG. 5 is an enlarged perspective view of a second opening and its vicinity of the acoustic filter in the baffle assembly in FIG. 2.

With reference to FIG. 5, the second openings 26 between the two segments of the acoustic filter 23 disposed in the second baffle 22 are slits viewed from the front side or the back side of the acoustic filter 23. Each slit or second opening 26 has a rectangular shape, and the ratio of the distance d between the two segments of the acoustic filter 23 to the width w of the acoustic filter 23 is not 1:1. The second openings 26 are each disposed above one of the first openings 25 and extend from the front side to the back side of the acoustic filter 23, thereby allowing air to pass therethrough while the sound emitted from the diaphragm 13 is transmitted to the back side of the second baffle 22.

Accordingly, the passages or second openings 26 each have a rectangular shape. The distance d between the two segments of the acoustic filter 23 is not equal to the width w of the acoustic filter 23. The acoustic filter 23 is an acoustic resistor having a predetermined thickness t.

Figure 6:
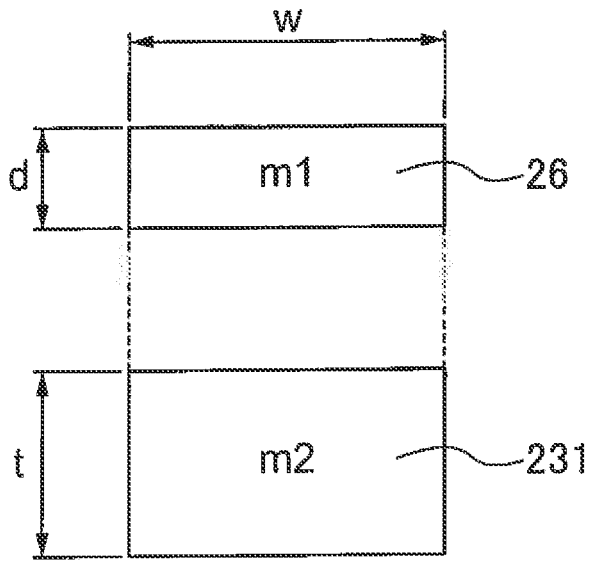
FIG. 6 is a schematic comparative view of the inner wall area and the opening area of the second opening.

With reference to FIG. 6, the area (opening area m1) of the second opening 26 is determined from the following formula:

$$m1 = w \times d \tag{1}$$

The surface area m2 of an inner wall 231 defining the second opening 26 is determined from the following formula:

$$m2 = w \times t \tag{2}$$

The formulae (1) and (2) indicate that the width w of the gap or second opening 26 significantly smaller than the thickness t of the acoustic filter 23 ($w \ll t$) causes the opening area m1 of the second opening 26 to be significantly smaller than the surface area m2 of the inner wall 231 defining the second opening 26 ($m1 \ll m2$). Since the second opening 26 is defined between the two inner walls 231 of the acoustic filter 23, air passing through the second opening 26 readily contacts the inner walls 231 defining the second opening 26. That is, a narrower air passage (or the opening area m1 of the second opening 26) increases the amount of air contacting the inner walls 231 each having the surface area m2 and thus substantially increases frictional loss of the air. The friction against the inner walls 231 decreases ease of movement of the air. The second opening 26 increases acoustic impedance and facilitates the setting of the acoustic impedance in comparison with, for example, a conventional opening having a large opening area through which air passes without contacting the side surfaces of the opening. This second opening 26 allows the diaphragm 13 to move with less linear distortion, resulting in an improvement in vibration balance.

Consequently, the headphone set 1 can reduce the sharpness (Q factor) of the driver unit 10 and thus can exhibit a smooth frequency response. The headphone set 1 having a small volume of the back air chamber can exhibit a smooth frequency response. This leads to high design flexibility of the headphone set 1, which may have a variety of shapes. The dimensions of the components described above are determined in accordance with the size of the back air chamber and desired characteristics of the electroacoustic transducer.

Headphone Set (2)

An electroacoustic transducer in accordance with another embodiment of the present invention will now be described, focusing on differences from the above-described embodiment.

Figure 7:
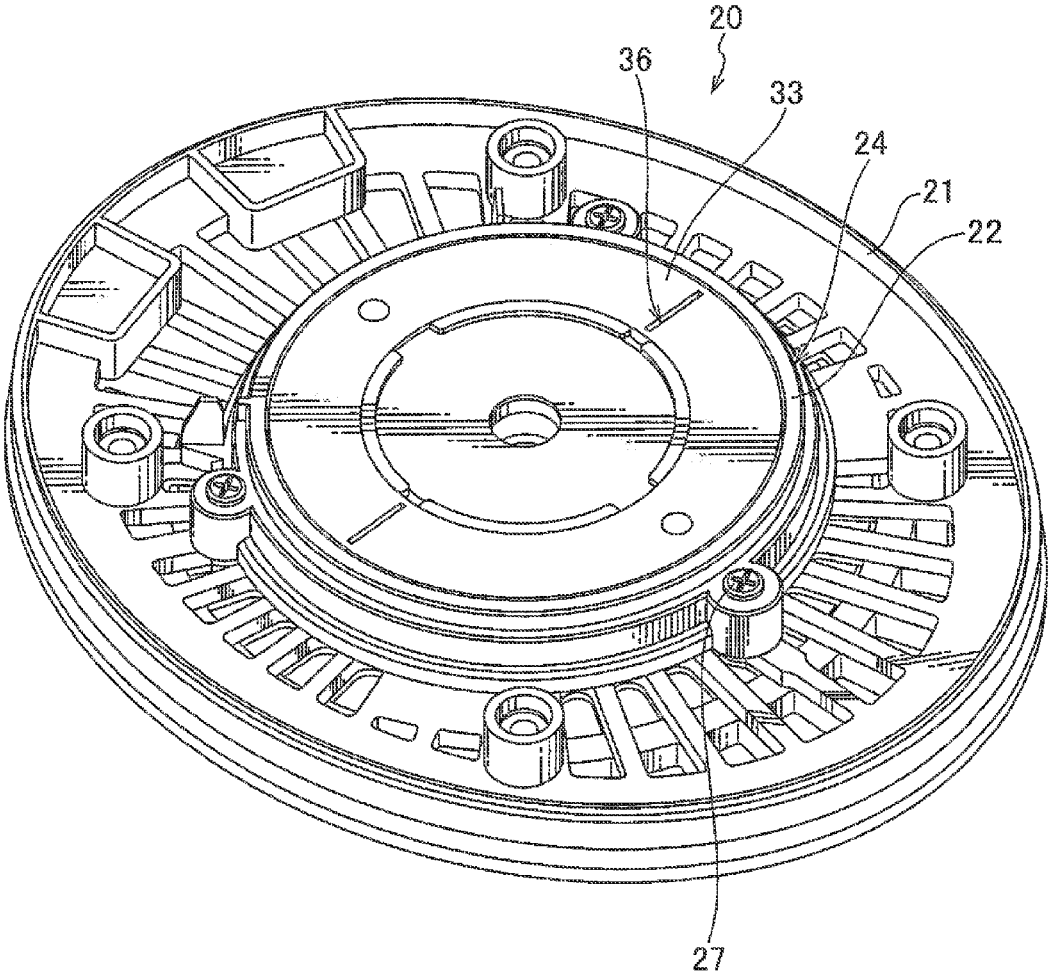
FIG. 7 is a perspective view of a baffle assembly of a headphone set that is another embodiment of the electroacoustic transducer of the present invention.

The acoustic filter 23 should not be limited to a combination of multiple segments described above. With reference to FIG. 7, for example, an acoustic resistor 33, which is a single member provided with second openings 36, may be used instead of the acoustic filter 23.

The shape of each second opening 36 should not be limited to a rectangle as in the second openings 26. Each second opening 36 may have any other shape that defines an opening area significantly smaller than the surface area of the inner wall such that a sufficient contact area is maintained between air and the inner walls defining the second openings 36. Thus, the shape of each second opening 36 may be, for example, an oval.

Headphone Set (3)

An electroacoustic transducer in accordance with yet another embodiment of the present invention will now be described, focusing on differences from the above-described embodiments.

Figure 8:
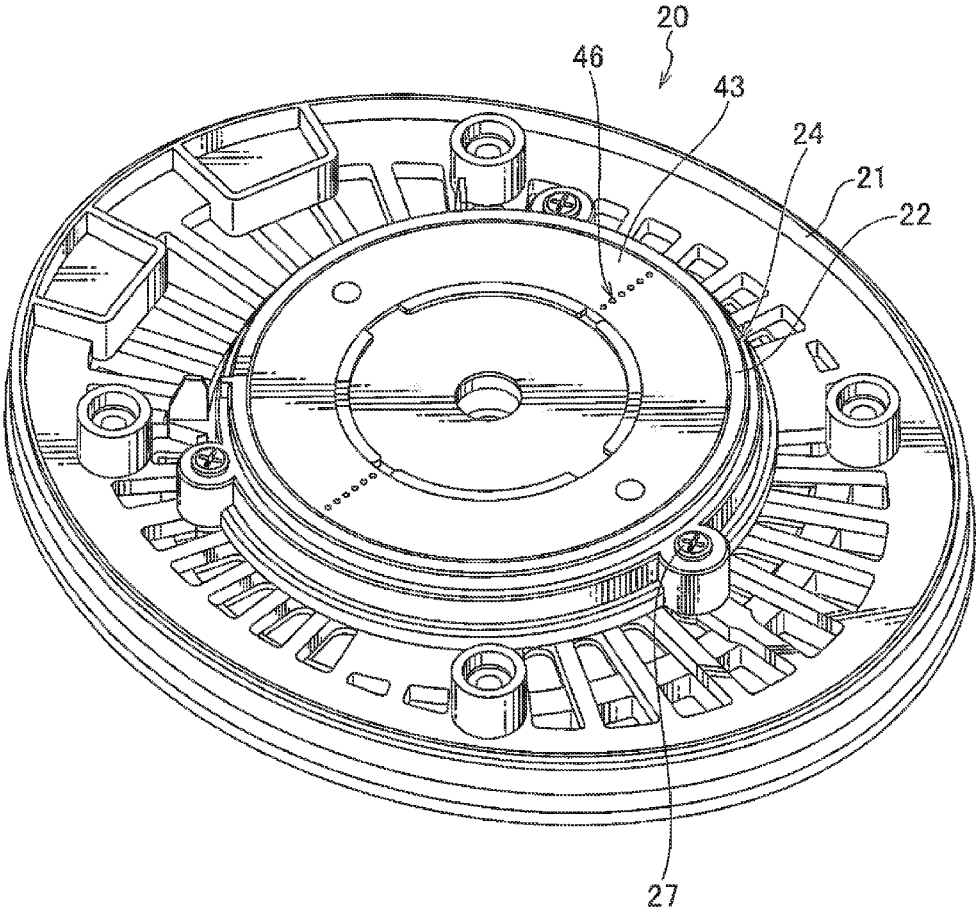
FIG. 8 is a perspective view of a baffle assembly of a headphone set that is yet another embodiment of the electroacoustic transducer of the present invention.

With reference to FIG. 8, each second opening 46 may have an exact circular shape. In this embodiment, an acoustic filter 43 has multiple second openings 46 aligned radially outward like the above-described second openings 26.

The electroacoustic transducers according to the embodiments described above each include the driver unit 10 of a dynamic type including the magnet 11 and the voice coil 12 for driving the driver of the diaphragm 13. Instead of the dynamic driver, the electroacoustic transducer in accordance with the present invention may have any other driver that includes a diaphragm and a driver for the diaphragm. The driver of the electroacoustic transducer in accordance with the present invention may be, for example, of a condenser type.

In the above-described embodiments, the present invention is applied to a headphone set. The present invention should not be limited to these examples and can be also applied to a loudspeaker and other electroacoustic transducers.

In accordance with the above-described embodiments, the present invention provides a headphone set 1 having an excellent frequency response even if a sufficient volume of a space is not provided on the back side of a diaphragm 13.

The invention claimed is:

1. An acoustic resistor included in an electroacoustic transducer, wherein the acoustic resistor comprises multiple segments, and wherein at least one opening which allows air to pass therethrough is formed by a gap between the multiple segments, wherein each of the multiple segments has a shape obtained by cutting a ring, wherein the at least one opening is formed by ends of the multiple segments which face each other without contacting each other, wherein inner walls of the at least one opening have a surface area larger than an opening area of the at least one opening.

2. The acoustic resistor according to claim 1, the electroacoustic transducer comprising:

a baffle having at least one opening extending through the baffle, wherein the at least one opening formed between the multiple segments of the acoustic resistor is disposed above the at least one opening extending through the baffle when the acoustic resistor is fixed to the baffle.

3. An electroacoustic transducer, comprising:

a baffle having a first opening extending through the baffle; and an acoustic resistor comprised of multiple segments with a gap between the multiple segments forming a second opening allowing air to pass therethrough, wherein each of the multiple segments has a shape obtained by cutting a ring, wherein the second opening is formed by ends of the multiple segments which face each other without contacting each other, and wherein inner walls of the second opening have a surface area larger than an opening area of the second opening.

4. The electroacoustic transducer according to claim 3, wherein the second opening is disposed above the first opening when the acoustic resistor is fixed to the baffle.

* * * * *